US009509093B2

(12) United States Patent
Shimizu

(10) Patent No.: US 9,509,093 B2
(45) Date of Patent: Nov. 29, 2016

(54) CONNECTOR

(71) Applicant: Yazaki Corporation, Tokyo (JP)

(72) Inventor: Tomohiko Shimizu, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/830,932

(22) Filed: Aug. 20, 2015

(65) Prior Publication Data

US 2016/0056574 A1 Feb. 25, 2016

(30) Foreign Application Priority Data

Aug. 22, 2014 (JP) ..... 2014-169317

(51) Int. Cl.
*H01R 13/627* (2006.01)
*H01R 13/629* (2006.01)
*H01R 13/631* (2006.01)

(52) U.S. Cl.
CPC ..... *H01R 13/631* (2013.01); *H01R 13/627* (2013.01); *H01R 13/62938* (2013.01)

(58) Field of Classification Search
CPC ..... H01R 13/627; H01R 13/62938; H01R 13/631; H01R 13/4538
See application file for complete search history.

(56) References Cited

U.S. PATENT DOCUMENTS 6,761,568 B2 * 7/2004 Bakker ..... H01R 13/4538 439/140
6,846,191 B2 * 1/2005 Hobbs ..... H01R 13/4538 439/140
7,524,200 B2 * 4/2009 Ikeya ..... H01R 13/62938 439/157
8,075,351 B2 * 12/2011 Park ..... H01R 13/40 439/372
2005/0059280 A1 * 3/2005 Hobbs ..... H01R 13/4538 439/140
2009/0203248 A1 8/2009 Matsumura et al.

FOREIGN PATENT DOCUMENTS

JP 2000-195610 A 7/2000
JP 2009-187865 A 8/2009

* cited by examiner

*Primary Examiner* — James Harvey
*Assistant Examiner* — Oscar C Jimenez
(74) *Attorney, Agent, or Firm* — Sughrue Mion, PLLC

(57) ABSTRACT

When a female connector body is inserted into a hood portion in a temporary lock state of a moving plate, plate lifting locks are deflected in a falling-over direction which is different from an outside direction of a male connector housing by lock portions and the plate lifting locks and the lock portions are engaged with each other after the plate lifting locks are deflected in the falling-over direction.

4 Claims, 18 Drawing Sheets

CONNECTOR

CROSS REFERENCE TO RELATED APPLICATIONS

This application is based on Japanese Patent Application No. 2014-169317 filed on Aug. 22, 2014, the contents of which are incorporated herein by reference.

BACKGROUND OF THE INVENTION

1.Field of the Invention

The present disclosure relates to a connector provided with a moving plate for positioning and protecting male type electric contact portions of male terminals.

2. Description of the Related Art

A connector to be used for electric connection includes a male connector and a female connector. The male connector is provided at an end part of one electric wire bundle while the female connector is provided at an end part of the other electric wire bundle. The male connector includes a male connector housing and a large number of male terminals. The male connector housing has a hood portion and a male terminal reception portion. The male terminals are received in the connector housing. When there are a large number of male terminals, the male connector further includes a moving plate. The moving plate is provided for positioning and protecting male type electric contact portions (male tubs) of the male terminals protruding into the hood portion of the male connector when the female connector has not been fitted to the male connector yet. The moving plate is installed to be temporarily locked in an internal intermediate position of the hood portion. The connector configured thus is, for example, disclosed in JP-A-2000-195610.

When there are more poles than those of the connector disclosed in JP-A-2000-195610, it is effective to provide a lever so that connector fitting and release between the male connector and the female connector can be performed by operation on the lever. Although such a lever is not shown, JP-A-2009-187865 discloses a multipolar connector including a moving plate in its configuration.

In the connector disclosed in JP-A-2009-187865, it is necessary to move the moving plate together with the female connector for the sake of connector fitting between the male connector and the female connector. To this end, a structure in which a part of the moving plate can be broken is used. Accordingly, when connector release is performed after the connector fitting, the moving plate is left behind in a deep position of the hood portion of the male connector. That is, in the background art, there is a problem that the moving plate cannot be returned to its original position after connector fitting has been once performed.

SUMMARY OF THE INVENTION

The present disclosure has been developed in consideration of the foregoing circumstances. An object of this disclosure is to provide a connector with a structure in which a moving plate can be returned to its original position at the time of releasing of the connector.

In order to solve the foregoing problem, for example, a connector includes:

a male connector including a male connector body and a moving plate; and a female connector including a female connector body and a lever;

wherein the male connector body includes a male connector housing made of resin with insulating properties, and a plurality of male terminals are made of metal with electric conductivity;

wherein the moving plate includes a plate body made of resin with insulating properties;

wherein the female connector body includes a female connector housing made of resin with insulating properties, and a plurality of female terminals are made of metal with electric conductivity;

wherein the male connector housing includes a hood portion and a male terminal reception portion, the hood portion receives the female connector movably in a fitting or releasing direction of the male connector and the female connector, and the male terminal reception portion is disposed in a deep position of an internal space of the hood portion;

wherein each of the male terminals includes a male type electric contact portion and an electric wire connection portion, the male type electric contact portion protrudes from the male terminal reception portion toward the internal space, and the electric wire connection portion is received in the male terminal reception portion continuously to the male type electric contact portion;

wherein the plate body includes a pair of locked portions and a pair of plate lifting locks, the pair of locked portions are disposed in opposite side portions of the plate body in a longitudinal direction of the male connector perpendicular to the fitting or releasing direction, and the pair of plate lifting locks are disposed in opposite side portions of the plate body in a lateral direction of the male connector perpendicular to the longitudinal direction of the male connector;

wherein the female connector housing includes a pair of arm action portions and a pair of lock portions, the pair of arm action portions are disposed in opposite side portions of the female connector housing in the longitudinal direction of the male connector, and the pair of lock portions are disposed in opposite side portions of the female connector housing in the lateral direction of the male connector;

wherein the hood portion includes a pair of arm-like lock portions and a pair of lock deflection regulating portions, the pair of arm-like lock portions are disposed in opposite side portions of the hood portion in the longitudinal direction of the male connector, and the pair of lock deflection regulating portions are disposed in opposite side portions of the hood portion in the lateral direction of the male connector;

wherein a fitting between the male connector and the female connector is performed as:

the moving plate is inserted into the hood portion and the locked portions are locked on the arm-like lock portions so that the moving plate is brought into a temporary lock state and the male type electric contact portions are positioned and protected by the plate body in the temporary lock state;

when the female connector body is inserted into the hood portion in the temporary lock state of the moving plate, the plate lifting locks are configured to be deflected in a falling-over direction which is different from an outside direction of the male connector housing by the lock portions and the plate lifting locks and the lock portions are engaged with each other after the plate lifting locks are deflected in the falling-over direction; and the lever is operated to apply pressure to the plate body by the female connector body while making the female connector body close to the male connector body, and the temporary lock state of the moving plate is released by the arm action portions; and wherein a release between the male connector and the female connector is performed as:

when the lever is operated to keep the female connector body away from the male connector body, deflection of the plate lifting rocks toward in the outside direction is regulated by the lock deflection regulating portions, and the engagement between the plate lifting locks and the lock portions is maintained due to the regulation, while the moving plate is moved to be lifted up together with the female connector body due to the maintained engagement; and when the engagement between the plate lifting locks and the lock portions is released after the moving plate is recovered to the temporary lock state by the arm action portions and after the plate lifting locks are moved to positions where the plate lifting locks are not regulated by the lock deflection regulating portions, the plate lifting locks are deflected in the outside direction by the lock portions so that the engagement between the plate lifting locks and the lock portions is released.

For example, in the connector according to the above configuration, when the temporary lock state of the moving plate is released by external force before the fitting between the male connector and the female connector and the moving plate sinks down into the male terminal reception portion, the plate lifting locks are deflected in the falling-over direction by the lock portions to be engaged with the lock portions.

For example, in the connector according to the above configuration, the outside direction of the male connector housing is same as the lateral direction of the male connector. Also, for example, the falling-over direction is same as the longitudinal direction of the male connector.

According to the above configurations, the connector includes a male connector provided with a male connector body and a moving plate, and a female connector provided with a female connector body and a lever. In addition, the connector has a structure as follows. That is, a pair or a plurality of pairs of lock portions are formed in the female connector body. A pair or a plurality of pairs of plate lifting locks for engaging with the lock portions and releasing the engagement are formed in the moving plate. A plurality of lock deflection regulating portions for regulating deflection of the plate lifting locks are formed in the male connector body. Further, the plate lifting locks are formed so that different deflection can be made in accordance with their relative positions to the lock deflection regulating portions. When the connector configured thus is used, the moving plate can be lifted up at the time of connector release. Accordingly, the present disclosure has an advantage that the moving plate can be returned to its original position at the time of connector release.

Also, according to the above configurations, connector fitting can be performed even when the moving plate has sunk down to a deep position (the male terminal reception portion side) of the internal space of the hood portion. That is, even in the state where the lock deflection regulating portions have been disposed adjacently to the plate lifting locks of the moving plate that has sunk down, the plate lifting locks can be deflected not outward but in a falling-over direction so that the plate lifting locks and the lock portions will be able to be engaged with each other without any damage. Accordingly, when the connector according to the present disclosure is used, there is an advantage that connector fitting can be performed without any damage even when the moving plate has sunk down.

DETAILED DESCRIPTION OF THE EXEMPLARY EMBODIMENTS

A connector includes a male connector provided with a male connector body and a moving plate, and a female connector provided with a female connector body and a lever. The male connector body includes a male connector housing and a plurality of male terminals made of metal, and the moving plate includes a plate body. On the other hand, the female connector body includes a female connector housing and a plurality of female terminals made of metal.

A hood portion is formed in the male connector housing so that the female connector can be received in the hood portion movably in a fitting/releasing direction of connector. In addition, a pair or a plurality of pairs of lock deflection regulating portions are formed in the hood portion so as to be disposed on opposite side portions of the hood portion in a lateral direction of the connector. A pair or a plurality of pairs of plate lifting locks are formed in the plate body so as to be disposed in opposite side portions of the plate body in a longitudinal direction of the connector. A pair or a plurality of pairs of lock portions are formed in the female connector housing so as to be disposed in opposite side portions of the female connector housing in the lateral direction of the connector.

The plate lifting locks are formed into shapes capable of having different deflection in accordance with relative positions between the plate lifting locks and the lock deflection regulating portions. Specifically, the plate lifting locks are formed into shapes deflectable in a falling-over direction and also deflectable outward.

Embodiment

Figure 1:
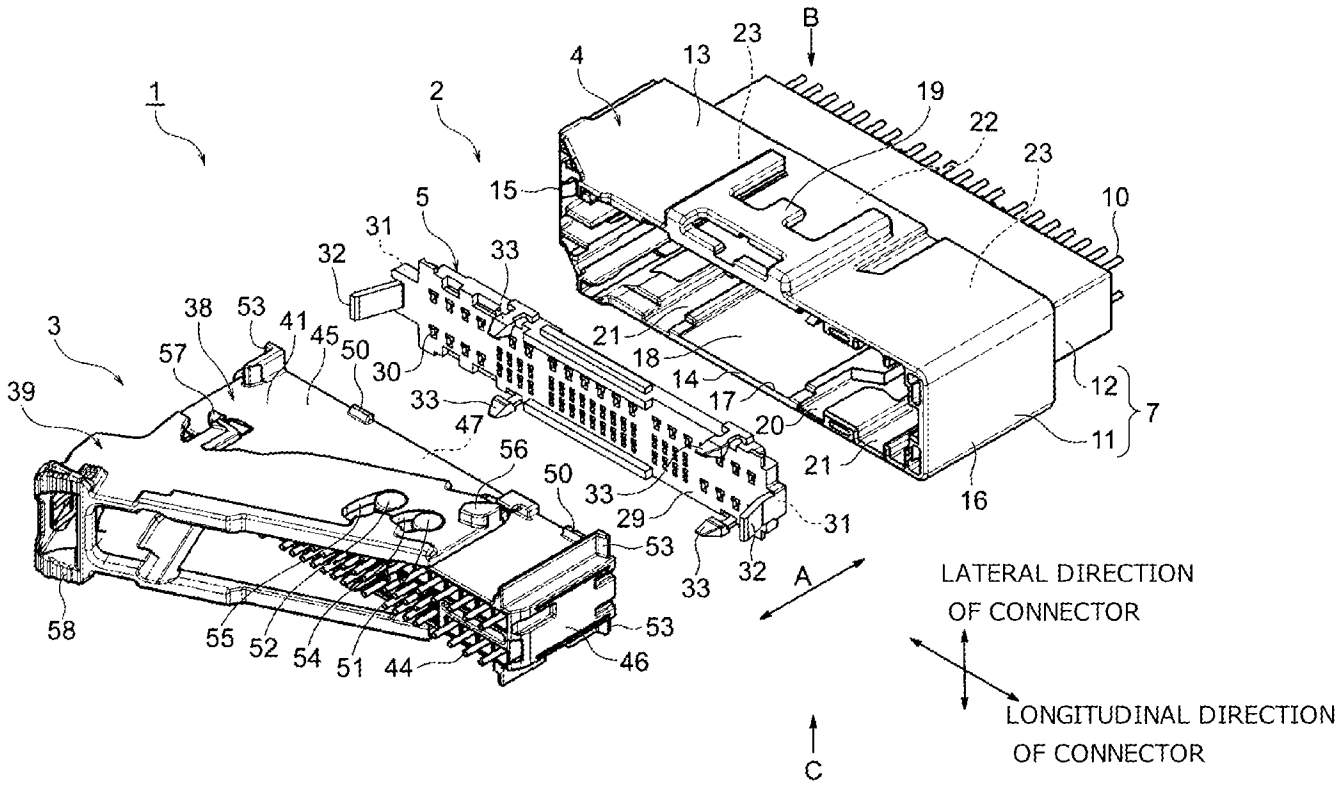
FIG. 1 is an exploded perspective view showing the configuration of a connector according to the present disclosure.
Figure 2:
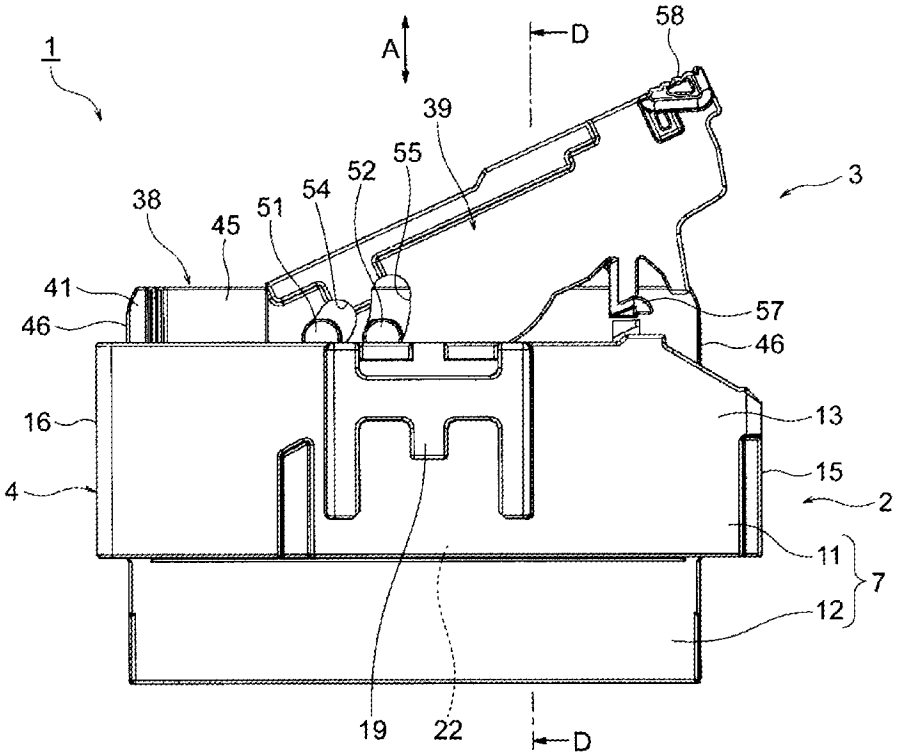
FIG. 2 is a view (in which electric wires are not shown) of the connector observed from the arrow B in FIG. 1, showing a state of the connector immediately after the start of connector fitting.
Figure 3:
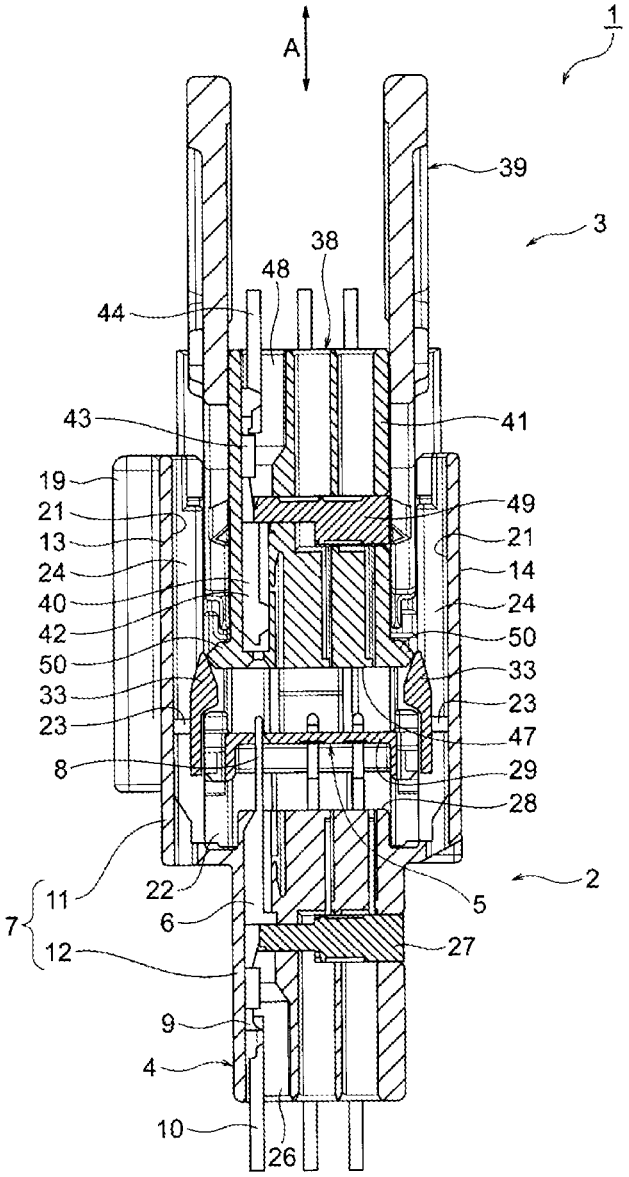
FIG. 3 is a sectional view taken on line D-D in FIG. 2.
Figure 4:
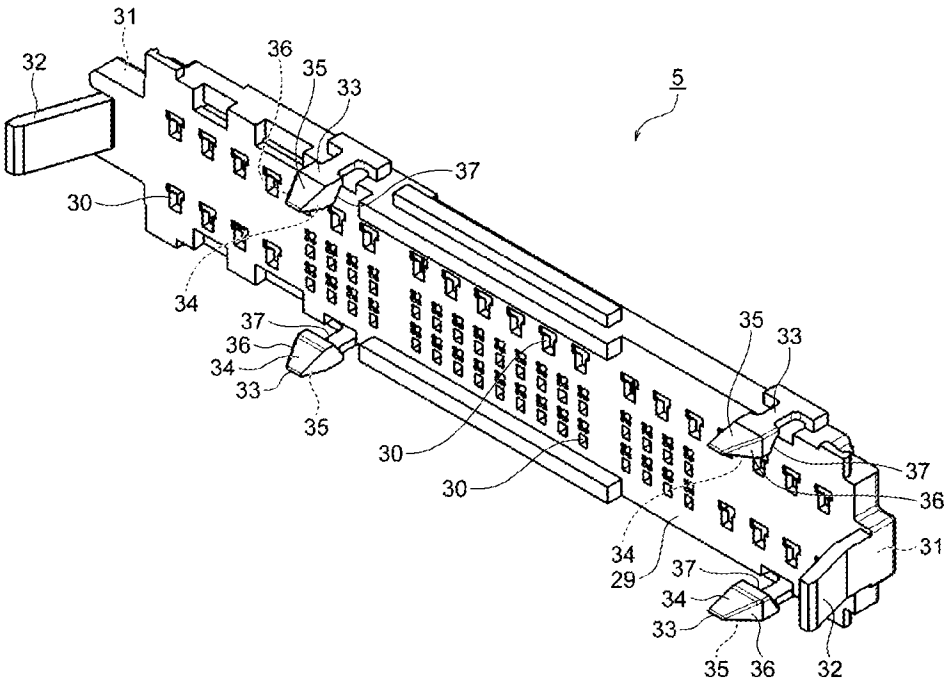
FIG. 4 is a perspective view of a moving plate.

An embodiment will be described below with reference to the drawings. FIG. 1 is an exploded perspective view showing the configuration of the connector according to the present disclosure. FIG. 2 is a view showing a state of the connector immediately after the start of connector fitting. FIG. 2 is a view (in which electric wires are not shown) of the connector observed from the arrow B in FIG. 1. FIG. 3 is a sectional view taken on line D-D in FIG. 2. FIG. 4 is a perspective view of the moving plate.

Figure 5:
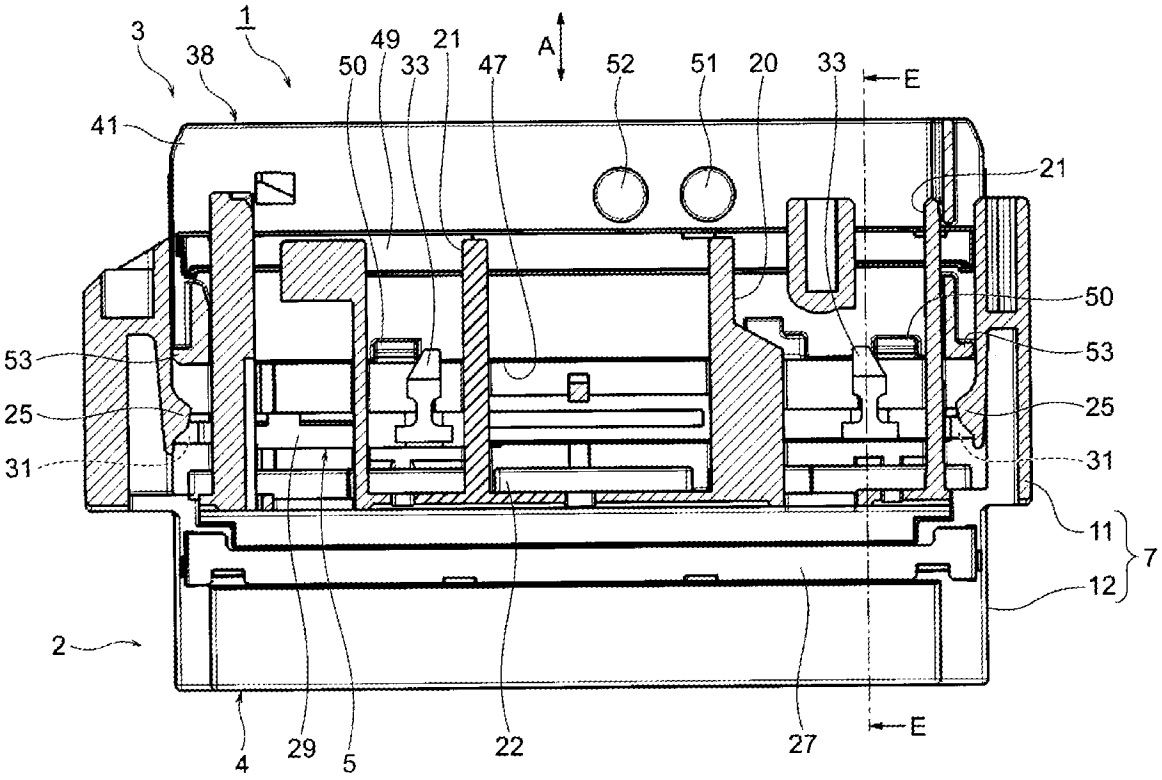
FIG. 5 is a view (which includes a section and in which the electric wires, terminals and a lever are not shown) of the connector observed from the arrow C in FIG. 1, showing a state of the connector immediately after the start of connector fitting.
Figure 6:
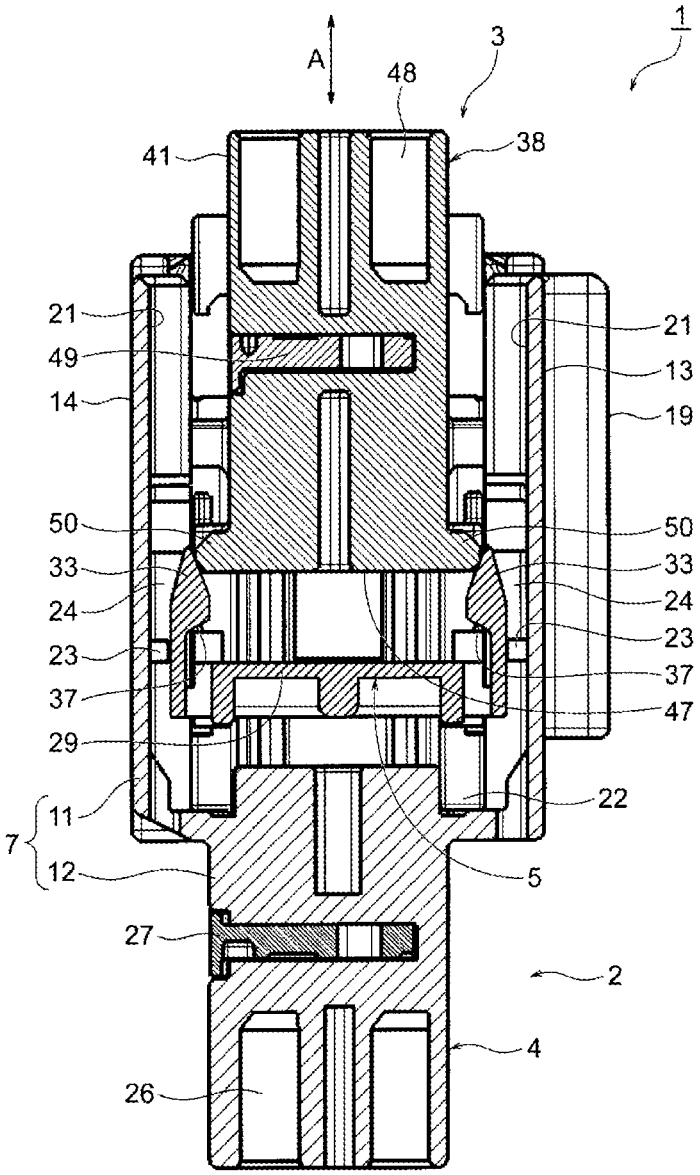
FIG. 6 is a sectional view taken on line E-E in FIG. 5.
Figure 7:
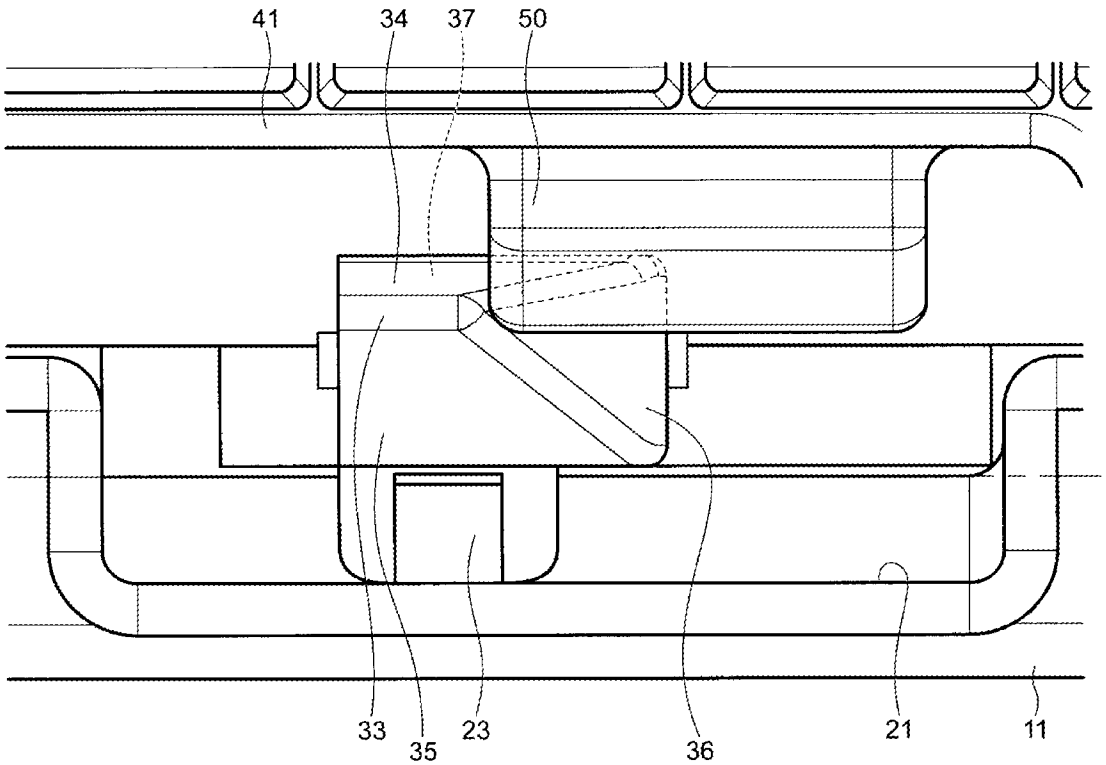
FIG. 7 is a plan view showing a state of plate lifting locks and lock portions in FIG. 5 and FIG. 6.

FIG. 5 is a view (which includes a section and in which the electric wires, terminals and a lever are not shown) of the connector observed from the arrow C in FIG. 1, showing a state of the connector immediately after the start of connector fitting. FIG. 6 is a sectional view taken on line E-E in FIG. 5. FIG. 7 is a plan view showing a state of the plate lifting locks and the lock portions in FIG. 5 and FIG. 6.

<Configuration of Connector>In FIG. 1, a connector 1 is, for example, used in a cowl side of a car. More in detail, the connector 1 is used for gathering a large number of electric wires (circuits) wired in a so-called instrument panel, an engine, a floor, etc. The connector 1 includes a male connector 2 and a female connector 3. Connector fitting/release between the male connector 2 and the female connector 3 is carried out in the direction of the arrow A. As is understood from FIG. 1, the connector 1 is a multipolar connector, which is formed as a comparatively large product. First, the configurations and structures of the male connector 2 and the female connector 3 will be described.

<Configuration of Male Connector>In FIG. 1 to FIG. 3, the male connector 2 includes a male connector body 4 and a moving plate 5.

<Configuration of Male Connector Body, and Configuration and Structure of Male Terminals>

The male connector body 4 includes a plurality (large number) of male terminals 6 made of metal with electric conductivity, and a male connector housing 7 made of resin with insulating properties. Each male terminal 6 includes a male type electric contact portion 8 and an electric wire connection portion 9 continuous to the male type electric contact portion 8. The male type electric contact portion 8 is formed into a male shape called a male tub, a pin or the like. The electric wire connection portion 9 is formed as a part to be connected to a terminal of an electric wire 10.

<Structure of Male Connector Housing>

The male connector housing 7 includes a hood portion 11 and a male terminal reception portion 12. The hood portion 11 and the male terminal reception portion 12 are formed into an integrated shape by resin molding. In addition, the hood portion 11 is formed as a part in which the female connector 3 can be received movably in the fitting/releasing direction of the connector (direction of the arrow A). Here, define directions perpendicular to the fitting/releasing direction of the connector as a longitudinal direction of the connector and a lateral direction of the connector as shown in FIG. 1. The hood portion 11 includes a pair of longitudinal side walls 13 and 14 formed in the longitudinal direction of the connector, a pair of lateral side walls 15 and 16 formed in the lateral direction of the connector, an opening portion 17 and an internal space 18 (to say other words, the lateral side walls 15 and 16 are formed and disposed in opposite wall portions in the longitudinal direction of the connector, and the longitudinal side walls 13 and 14 are formed and disposed in opposite side portions in the lateral direction of the connector, while the opening portion 17 and the internal space 18 are formed in addition to the side walls 13 to 14).

A bracket attachment portion 19 is formed in the longitudinal side wall 13. The bracket attachment portion 19 is a part to be attached to a not-shown bracket. The bracket attachment portion 19 is formed on the external surface side. A fulcrum protrusion reception groove 20 and a lock opposed portion 21 are formed in the internal surface of each longitudinal side wall 13, 14. The fulcrum protrusion reception groove 20 is formed as a groove part for receiving and guiding a fulcrum protrusion 56 of a lever 39 which will be described later. Incidentally, the fulcrum protrusion reception groove 20 and the fulcrum protrusion 56 belong to an LIF mechanism, and their detailed description will be omitted here.

Each lock opposed portion 21 is formed to extend in the fitting/releasing direction of the connector. The lock opposed portion 21 is formed to extend straightly from the opening portion 17 to a deep position 22 in the internal space 18 of the hood portion 11. In addition, the lock opposed portion 21 is formed and disposed in a position opposed to a plate lifting lock 33 of the moving plate 5, which will be described later.

A lock deflection regulating portion 23 is formed and disposed in the middle of each lock opposed portion 21. The lock deflection regulating portion 23 is formed to regulate a deflection of the plate lifting lock 33 of the moving plate 5. That is, the lock deflection regulating portion 23 regulates the deflection to prevent release from engagement between the plate lifting lock 33 and a lock portion 50 of the female connector 3. The lock deflection regulating portion 23 is formed into a shape protruding from the groove bottom surface of the lock opposed portion 21. Incidentally, the space on the opening portion 17 side with respect to the lock deflection regulating portion 23 serves as a deflectable space 24 for the plate lifting lock 33.

In FIG. 1 and FIG. 5, a guide portion (with no reference sign) for the moving plate 5 or the female connector 3 is formed in the internal surface of each lateral side wall 15, 16. An arm-like lock portion 25 is also formed in each internal surface. The arm-like lock portion 25 is formed as an arm-like lock part for temporarily locking the moving plate 5. The arm-like lock portion 25 is formed so that an arm base part thereof can extend continuously to the middle of the internal surface while the arm distal end side can face the deeper side of the hood portion 11. In addition, the arm-like lock portion 25 is formed as a part that is flexible enough to allow the arm distal end side to move outward. Although not shown especially, a hook-like part on which the moving plate 5 can be hooked is formed in the arm-like lock portion 25.

In FIG. 1 to FIG. 3, the male terminal reception portion 12 is formed and disposed continuously to the deep position 22 in the internal space 18 of the hood portion 11. A plurality (large number) of terminal reception chambers 26 are formed in the male terminal reception portion 12. A lance (with no reference sign) is formed in each terminal reception chamber 26 so that a male terminal 6 can be locked in the lance. In this embodiment, the male terminal 6 received in the terminal reception chamber 26 is locked doubly by a spacer 27. The male terminal 6 is received so that the male type electric contact portion 8 belonging to the male terminal 6 can penetrate a partition 28 and protrude into the internal space 18.

<Structure of Moving Plate>

In FIG. 1 and FIG. 4, the moving plate 5 is a resin molded article with insulating properties. The moving plate 5 is installed to be temporarily locked in an internal intermediate position of the hood portion 11. The moving plate 5 is formed so that the moving plate 5 can position and protect the male type electric contact portions 8 of the male terminals 6 protruding into the hood portion 11 when the female connector 3 has not been fitted to the male connector 2 yet. The moving plate 5 configured thus is formed into a depicted shape with a plate body 29. Incidentally, the moving plate 5 may be also referred to as an aligning plate.

The plate body 29 is formed as a plate-like part having an external shape meeting the sectional shape of the hood portion 11. In the embodiment, the plate body 29 is formed as a rectangular plate-like part in which sides extending in the longitudinal direction of the connector are comparatively long. A plurality (large number) of insertion portions 30 to which the male type electric contact portions 8 can be inserted are formed to penetrate the plate body 29. In addition, a pair of locked portions 31, a pair of guide portions 32 and two pairs of plate lifting locks 33 are formed in the plate body 29.

The locked portions 31 are formed and disposed in side portions opposed to the lateral side walls 15 and 16 of the male connector housing 7 (to say other words, the locked portions 31 are formed and disposed in opposite side portions in the longitudinal direction of the connector). The locked portions 31 are formed as parts to be hooked and temporarily locked in the arm-like lock portions 25 (see FIG. 5) of the male connector housing 7. The locked portions 31 are formed and disposed on the back surface side of the plate body 29.

The guide portions 32 are formed as piece-like parts with flexibility. The guide portions 32 configured thus are formed and disposed on the opposite side to the locked portions 31, that is, on the front surface side. The guide portions 32 are formed and disposed to be put between the lateral side walls 15 and 16 of the male connector housing 7 and a female connector body 38 of the female connector 3, which will be described later.

In FIG. 4, FIG. 5, FIG. 7 and FIG. 10, two plate lifting locks 33 are formed and disposed in each of the opposed side portions of the longitudinal side walls 13 and 14 of the male connector housing 7 (to say other words, two plate lifting locks 33 are formed and disposed in each of the opposite side portions in the lateral direction of the connector). The plate lifting locks 33 are formed as parts to be engaged with and released from the female connector body 38 of the female connector 3, which will be described later.

Each plate lifting lock 33 is formed into a depicted shape including an arm-like part protruding toward the female connector 3, and an engagement part extending continuously to the arm-like part. The plate lifting lock 33 is formed into a shape flexible enough to be deflected in a falling-over direction and also to be deflected outward. To say other words, the plate lifting lock 33 is formed into a shape that can have different deflection in accordance with its relative position to the lock deflection regulating portion 23 of the male connector housing 7.

Three tapers 34, 35 and 36 (see FIG. 7) and an engagement portion 37 are formed on the distal end side (in the engagement part) of each plate lifting lock 33. The three tapers 34, 35 and 36 are formed as slope parts of a mountain-like shape whose summit is formed by the protruding tip end of the plate lifting lock 33. The engagement portion 37 is formed as a part that can be engaged with a lock portion 50 of the female connector 3. Incidentally, the engagement portion 37 is also formed as a part that can be released from the lock portion 50.

Of the three tapers 34, 35 and 36, the taper 36 is formed as a part against which the lock portion 50 can abut at the time of connector fitting. The taper 36 will be described more specifically. The taper 36 is formed so that the direction of force from the lock portion 50 can be converted to a different direction from the fitting direction of the connector (direction of the arrow A). Since the plate lifting lock 33 includes the taper 36, the plate lifting lock 33 is formed as a part that can be deflected in the arrow direction D illustrated in FIG. 10, that is, deflected in the falling-over direction (direction of the arrow D) when the lock portion 50 abuts against the taper 36. Incidentally, the plate lifting lock 33 is deflected in the arrow direction D (falling-over direction) only in two patterns, that is, when the lock portion 50 abuts at the time of normal connector fitting as described above or when connector fitting is performed in the state where the moving plate 5 has sunk down to the deep position 22 of the hood portion 11. The plate lifting lock 33 is not deflected in the falling-over direction at the time of connector release.

The plate lifting lock 33 is formed as a part that can lift up the moving plate 5 through the female connector 3 at the time of connector release, that is, when the female connector 3 leaves the male connector 2.

<Configuration of Female Connector>

In FIG. 1 to FIG. 3, the female connector 3 includes a female connector body 38 and a lever 39.

<Configuration of Female Connector Body, and Configuration and Structure of Female Terminals>

The female connector body 38 includes a plurality (large number) of female terminals 40 made of metal with electric conductivity, and a female connector housing 41 made of resin with insulating properties. Each female terminal 40 includes a female type electric contact portion 42 and an electric wire connection portion 43 extending continuously to the female type electric contact portion 42. The female type electric contact portion 42 is formed into a box-like shape as a part for establishing electric connection with the male type electric contact portion 8. On the other hand, the electric wire connection portion 43 is formed as a part to be connected to a terminal of an electric wire 44.

<Structure of Female Connector Housing>

In FIG. 1, FIG. 2 and FIG. 5 to FIG. 7, the female connector housing 41 is formed into a box-like shape including a pair of longitudinal side walls 45 and a pair of lateral side walls 46 opposed to the longitudinal side walls 13 and 14 and the lateral side walls 15 and 16 of the male connector 2 respectively, and a plate opposed wall 47 opposed to the plate body 29 of the moving plate 5. A plurality (large number) of terminal reception chambers 48 are formed inside the female connector housing 41. In addition, the female connector housing 41 is also formed as a part for receiving the female terminals 40. A lance (with no reference sign) for locking a female terminal 40 is formed in each terminal reception chamber 48. In the embodiment, the female terminal 40 received in the terminal reception chamber 48 is locked doubly by a spacer 49. The female terminal 40 is electrically connected to a male type electric contact portion 8 of a male terminal 6 inserted through the plate opposed wall 47.

Two convex lock portions 50 are formed in each longitudinal side wall 45. The lock portions 50 are formed near the plate opposed wall 47. Each lock portion 50 is formed as a part serving as follows. That is, at the time of connector fitting, the lock portion 50 abuts against a plate lifting lock 33 of the moving plate 5 (abuts against a taper 36) so as to deflect the plate lifting lock 33 in the falling-over direction as shown by the arrow D in FIG. 10. After that, the lock portion 50 engages with the plate lifting lock 33 (engages with the engagement portion 37). In addition, the lock portion 50 is formed as a part serving as follows. That is, at the time of connector release (when the female connector 3 leaves the male connector 2), the lock portion 50 lifts up the moving plate 5 through the plate lifting lock 33 with which the lock portion 50 is engaged, so that the lock portion 50 will be able to push the plate lifting lock 33 outward to release the engagement therewith. Incidentally, the reference numerals 51 and 52 in the longitudinal side wall 45 represent cam protrusions to be engaged with the lever 39.

Two convex arm action portions 53 are formed in each lateral side wall 46 (see FIG. 1 and FIG. 5). The arm action portions 53 are formed and disposed near the plate opposed wall 47. Each arm action portion 53 is formed as a part serving as follows. That is, at the time of connector fitting, the arm action portion 53 abuts against an arm-like lock portion 25 of the male connector 2 so as to expand the arm-like lock portion 25 outward to thereby release the temporary lock state of the moving plate 5. In addition, the arm action portion 53 is formed as a part serving as follows. That is, at the time of connector release (when the female connector 3 leaves the male connector 2), the arm action portion 53 brings the moving plate 5 back to the temporary lock state again.

<Structure of Lever>

In FIG. 1, FIG. 2 and FIG. 4, the lever 39 is a resin molded article, which is used as a part of the LIF mechanism. Cam grooves 54 and 55 to be engaged with the cam protrusions 51 and 52 of the female connector body 38 are formed in the lever 39. In addition, fulcrum protrusions 56 to be engaged with the fulcrum protrusion reception grooves 20 of the male connector 2, a temporary lock portion 57 to be engaged with the male connector 2, etc. are formed in the lever 39. The lever 39 has a well-known structure, in which rotational operation is carried out by picking an operation portion 58.

Next, based on the aforementioned configurations and structures, description will be made about installation of the male connector 2, installation of the female connector 3, installation (connector fitting/release) between the male connector 2 and the female connector 3.

Figure 8:
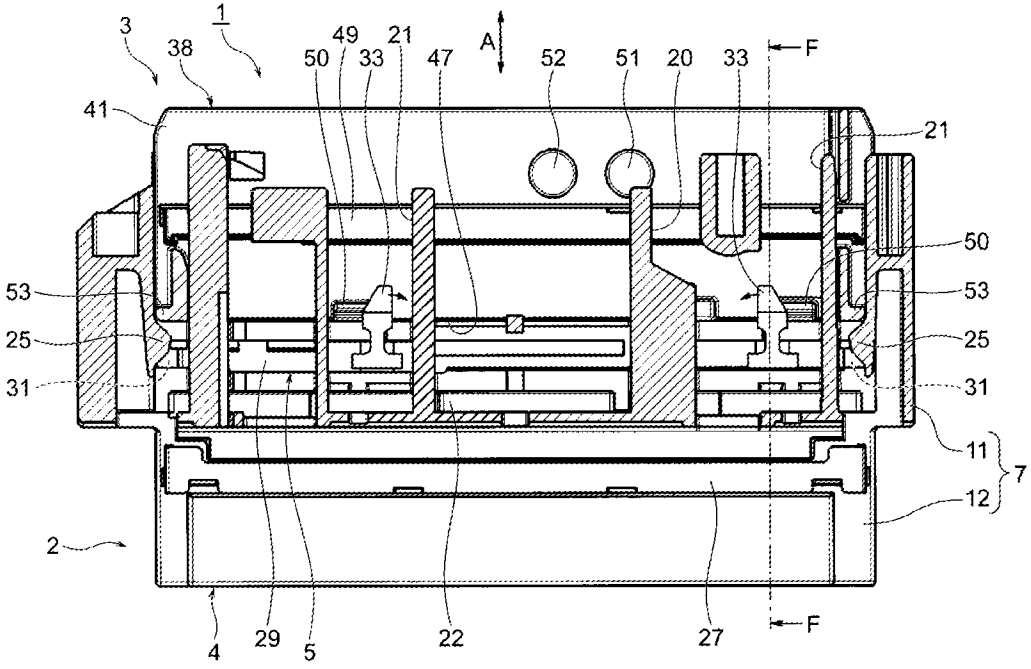
FIG. 8 is a view (which includes a section and in which the electric wires, the terminals and the lever are not shown) showing a state of the connector engaging in engagement between the lock portions and the plate lifting locks.
Figure 9:
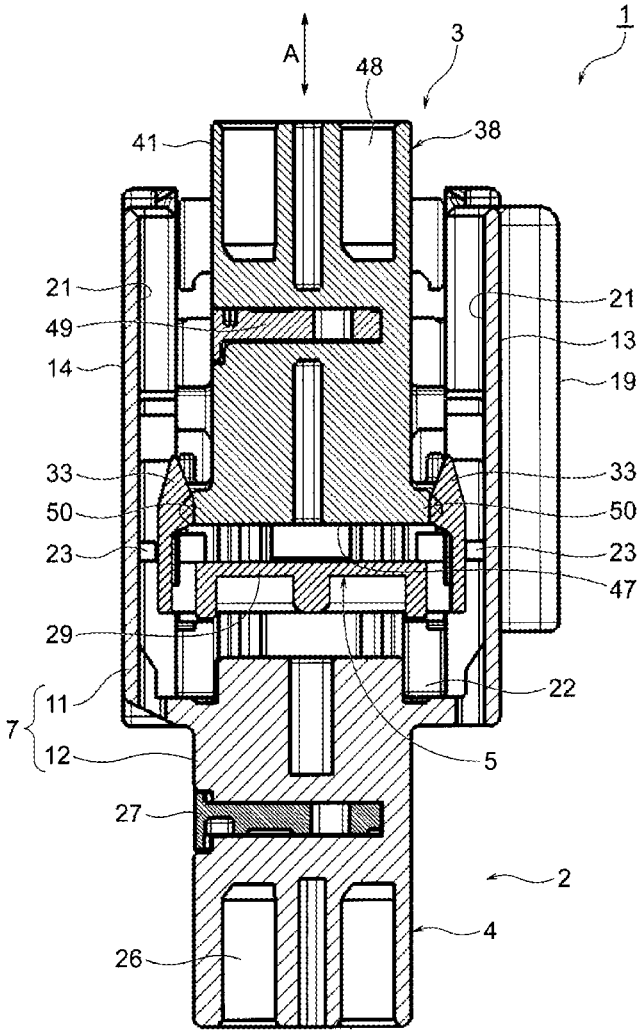
FIG. 9 is a sectional view taken on line F-F in FIG. 8.
Figure 10:
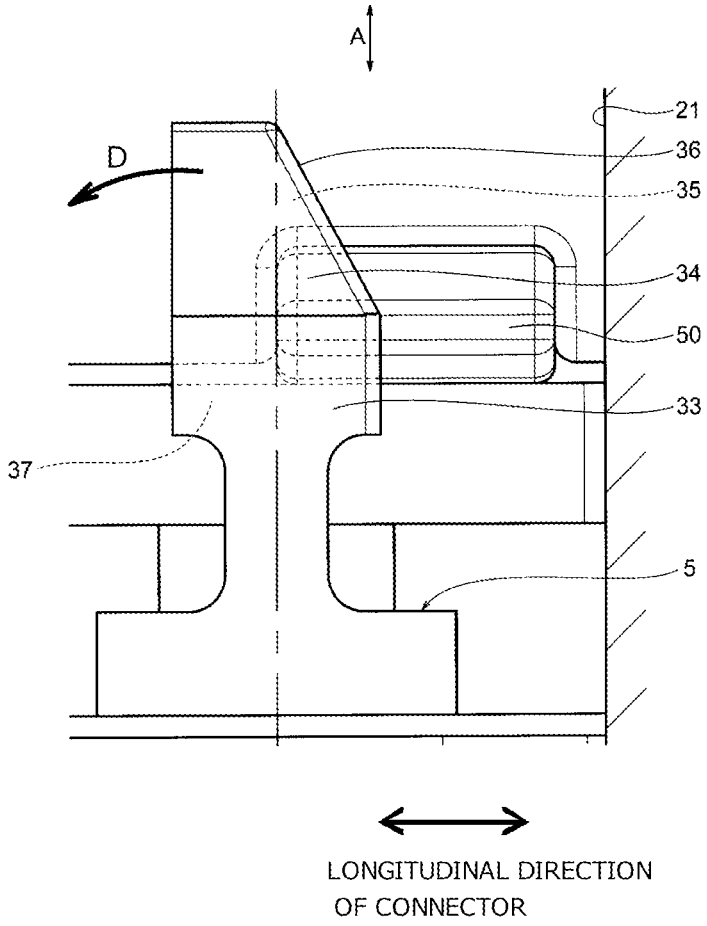
FIG. 10 is a main portion enlarged view of FIG. 8.
Figure 11:
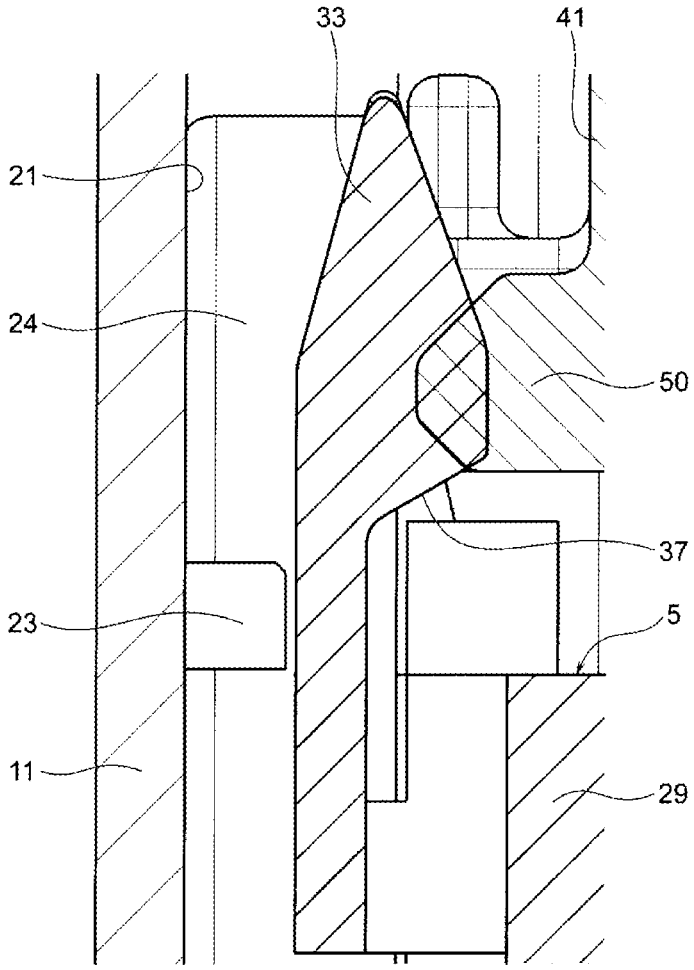
FIG. 11 is a main portion enlarged view of FIG. 9.

FIG. 8 is a view (which includes a section and in which the electric wires, the terminals and the lever are not shown) showing a state of the connector 1 engaging in engagement between the lock portions 50 and the plate lifting locks 33. FIG. 9 is a sectional view taken on line F-F in FIG. 8. FIG. 10 is a main portion enlarged view of FIG. 8. FIG. 11 is a main portion enlarged view of FIG. 9.

Figure 12:
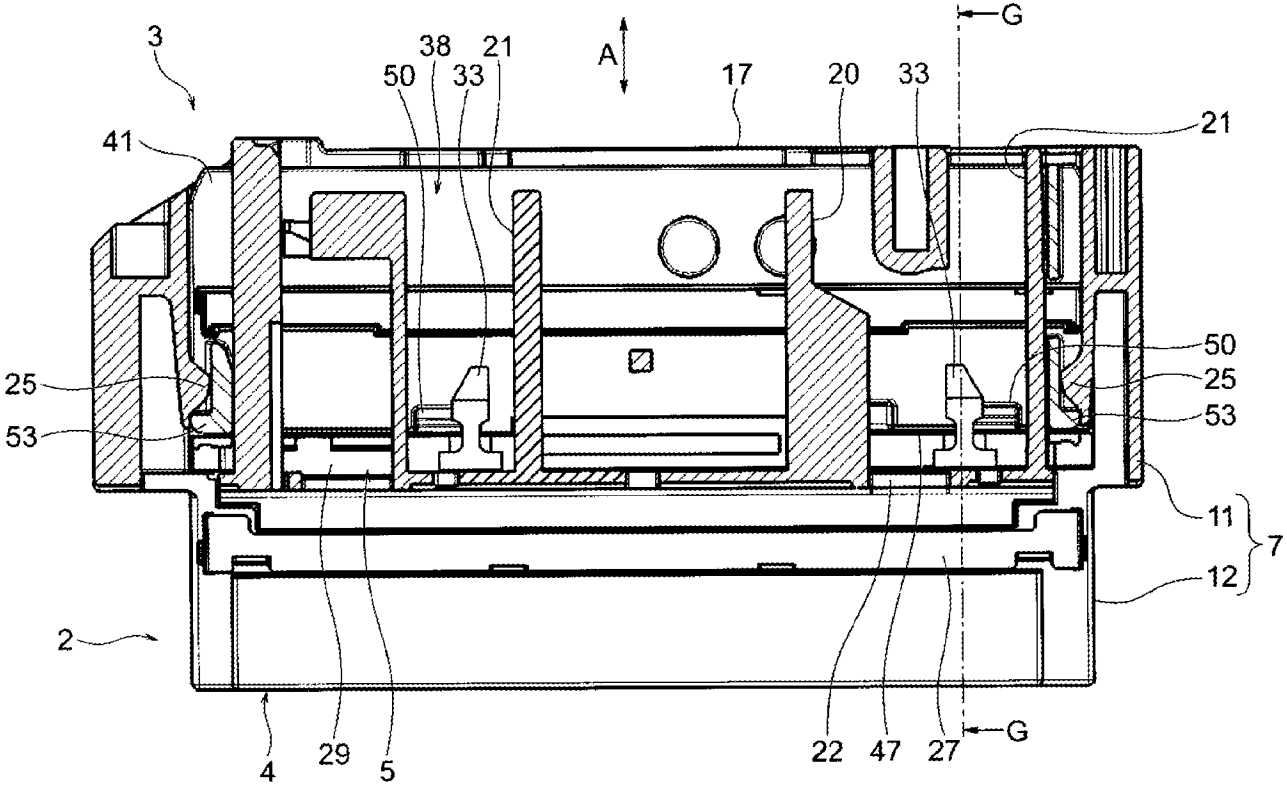
FIG. 12 is a view (which includes a section and in which the electric wires, the terminals and the lever are not shown) showing a state of the connector in which the moving plate has moved to a deep position of a hood portion.
Figure 13:
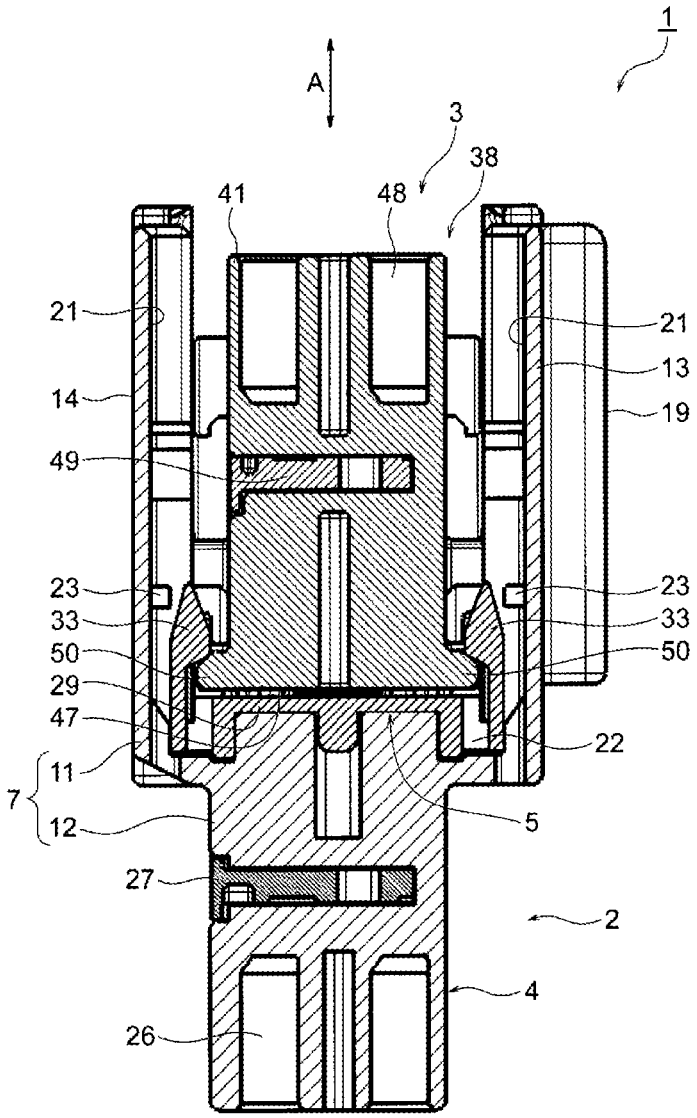
FIG. 13 is a sectional view taken on line G-G in FIG. 12.
Figure 14:
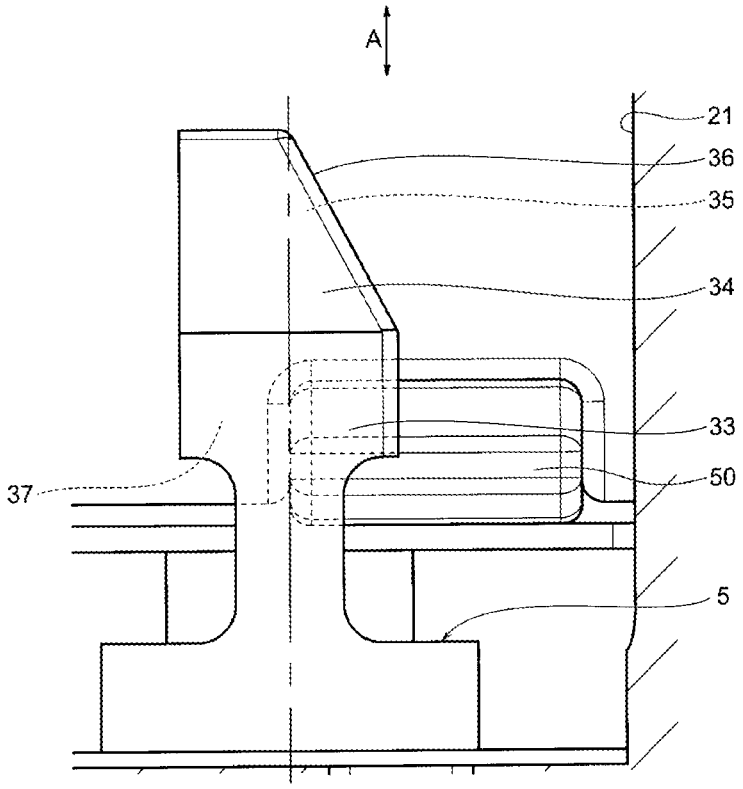
FIG. 14 is a main portion enlarged view of FIG. 12.
Figure 15:
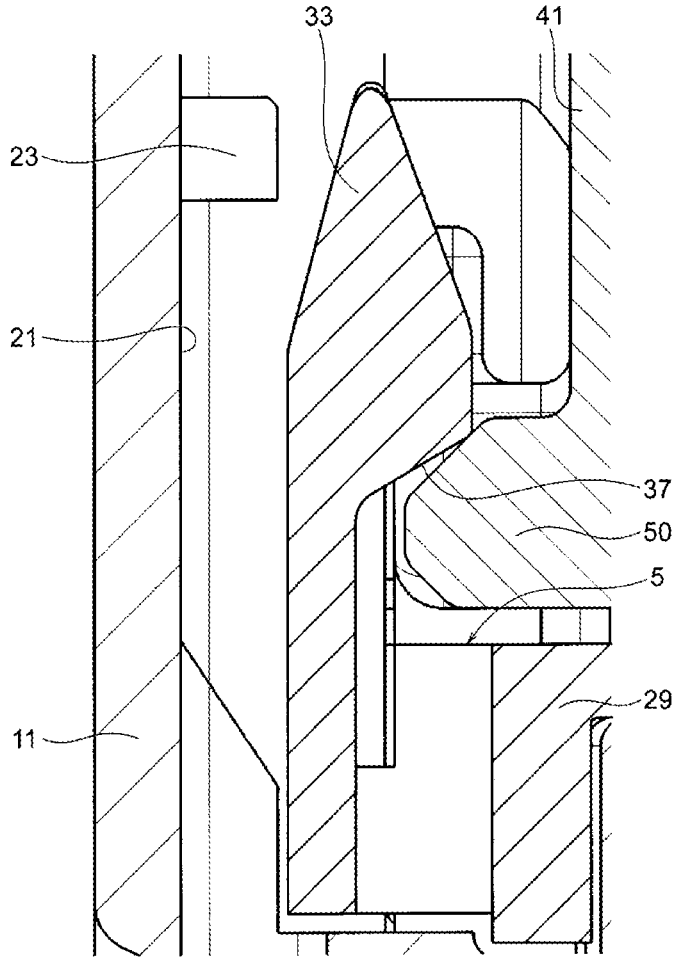
FIG. 15 is a main portion enlarged view of FIG. 13.

FIG. 12 is a view (which includes a section and in which the electric wires, the terminals and the lever are not shown) showing a state of the connector 1 in which the moving plate 5 has moved to the deep position 22 of the hood portion 11. FIG. 13 is a sectional view taken on line G-G in FIG. 12. FIG. 14 is a main portion enlarged view of FIG. 12. FIG. 15 is a main portion enlarged view of FIG. 13.

Figure 16:
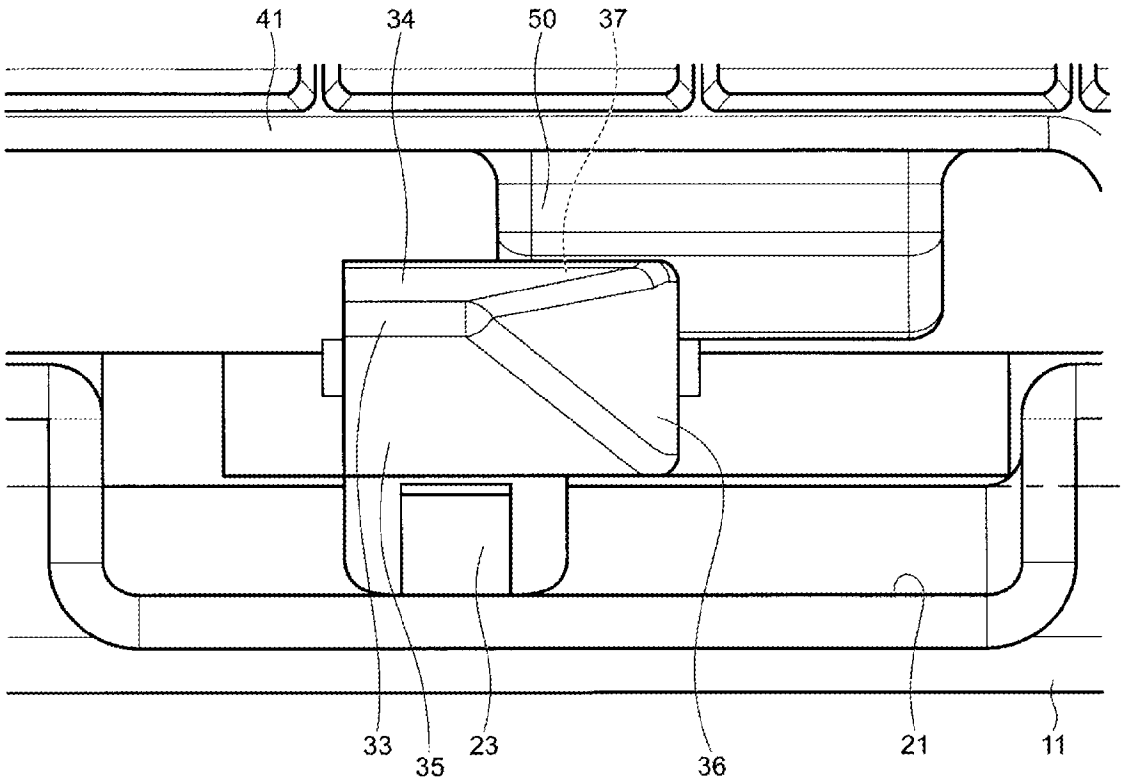
FIG. 16 is a plan view showing a state of the plate lifting locks and the lock portions in FIG. 12 and FIG. 13.
Figure 17:
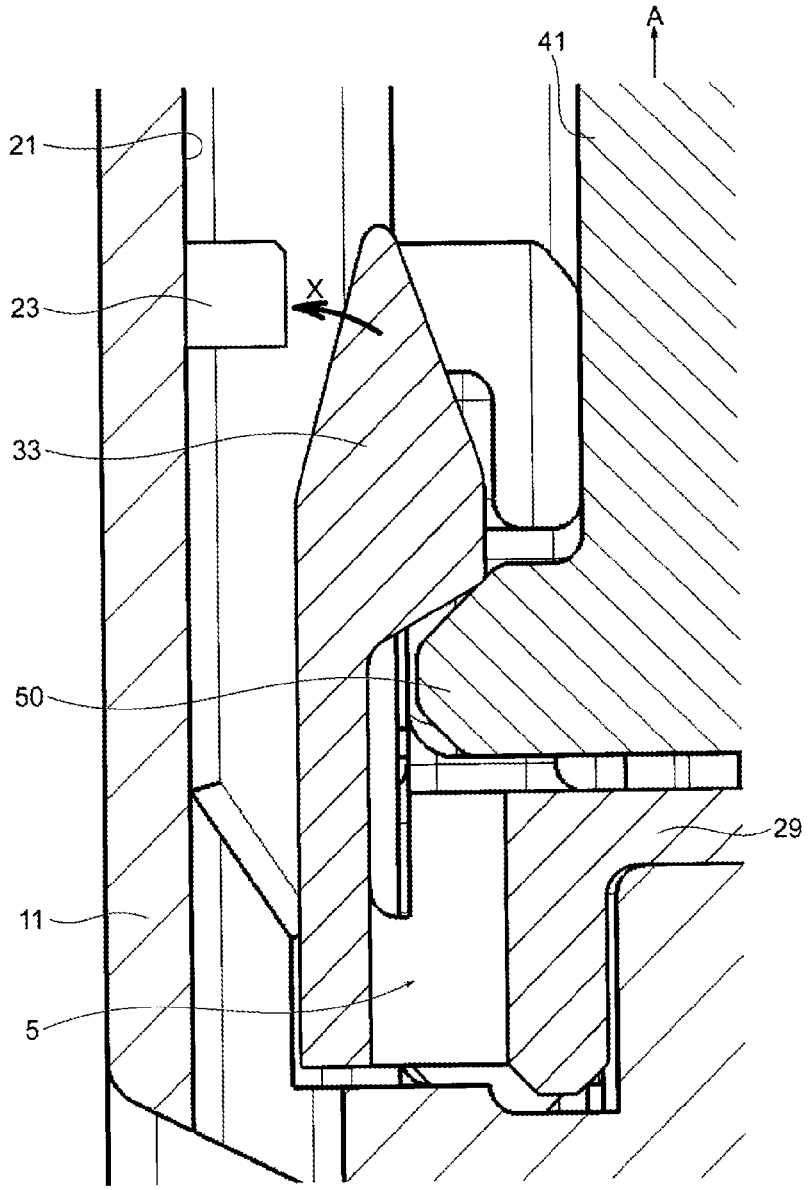
FIG. 17 is a main portion enlarged view relating to operation of the plate lifting locks and the lock deflection regulating portions immediately after the start of connector release.
Figure 18:
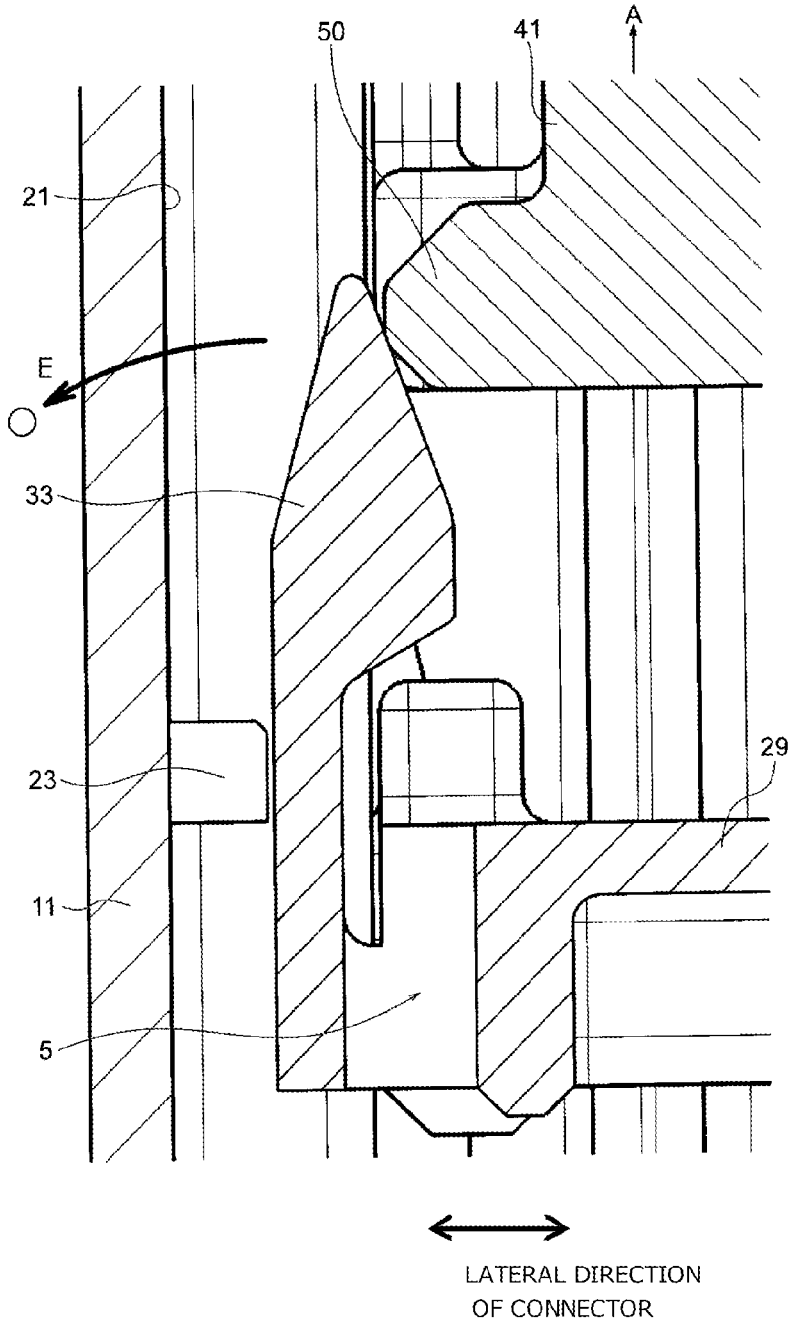
FIG. 18 is a main portion enlarged view relating to release from engagement between the lock portions and the plate lifting locks.

FIG. 16 is a plan view showing a state of the plate lifting locks 33 and the lock portions 50 in FIG. 12 and FIG. 13. FIG. 17 is a main portion enlarged view relating to operation of the plate lifting locks 33 and the lock deflection regulating portions 23 immediately after the start of connector release. FIG. 18 is a main portion enlarged view relating to release from engagement between the lock portions 50 and the plate lifting locks 33.

<Installation of Male Connector>

In FIG. 1 and FIG. 3, the male terminals 6 are received and locked in the male terminal reception portion 12 of the male connector housing 7, while the male terminals 6 are locked doubly by the spacer 27. When the male connector body 4 is assembled thus, the male type electric contact portions 8 of the male terminals 6 penetrate the partition 28 and protrude into the internal space 18. After the male connector body 4 is assembled, the moving plate 5 is inserted into the internal space 18 of the hood portion 11 through the opening portion 17. When the moving plate 5 is thus brought into a temporary lock state, installation of the male connector 2 is completed. In the temporary lock state of the moving plate 5, the male type electric contact portions 8 protruding into the internal space 18 are positioned and protected (see FIG. 11) by the plate body 31.

<Installation of Female Connector>

In FIG. 1 to FIG. 3, the female terminals 40 are received and locked in the terminal reception chambers 48 of the female connector housing 41, while the female terminals 40 are locked doubly by the spacer 49. When the female connector body 38 is assembled thus, the female type electric contact portions 42 of the female terminals 40 are disposed on the deep side of the plate opposed wall 47. After that, the lever 39 is attached to the outside of the female connector body 38 so that rotational operation can be performed desirably thereon. When the lever 39 is attached in its initial position as illustrated, installation of the female connector 3 is completed.

<Connector Fitting>

In FIG. 2 and FIG. 3, the female connector 3 is inserted into the hood portion 11 of the male connector 2 in the fitting direction of the connector (direction of the arrow A). Thus, the fulcrum protrusions 56 of the lever 39 are inserted into the fulcrum protrusion reception grooves 20 of the male connector 2, and guided in the fitting direction of the connector. At this time, each lock portion 50 of the female connector body 38 abuts against each plate lifting lock 33 of the moving plate 5 (abuts against the taper 36) as shown in FIG. 5 to FIG. 7.

When the plate lifting lock 33 receives pressure from the lock portion 50, the plate lifting lock 33 is deflected in the falling-over direction as shown by the arrow D in FIG. 10. Thus, the lock portion 50 passes through the protruding tip end side of the plate lifting lock 33 (see FIG. 8 to FIG. 11).

Incidentally, in the drawings, the lock portion 50 and the plate lifting lock 33 are depicted as if they lapped over each other. In fact, deflection occurs in accordance with the lapping amount.

When the lock portion 50 passes through the protruding tip end side of the plate lifting lock 33, the plate lifting lock 33 having been deflected in the falling-over direction returns to its original state. Thus, the engagement between the lock portion 50 and the plate lifting lock 33 is completed.

When the female connector 3 is further inserted in the fitting direction of the connector, the plate opposed wall 47 of the female connector body 38 in the female connector 3 comes in surface contact (abutment) with the plate body 29 of the moving plate 5 though not shown especially. On this occasion, the distal ends of the male type electric contact portions 8 positioned by the moving plate 5 are inserted into the plate opposed wall 47.

In addition, though not shown especially, when the lever 39 is operated and rotated in a predetermined direction, the female connector body 38 moves toward the deep position 22 of the hood portion 11. At this time, the plate body 29 of the moving plate 5 is pressed onto the plate opposed wall 47 of the female connector body 38. In addition, when the arm action portions 53 of the female connector body 38 abut against the arm-like lock portions 25 of the male connector 2 to expand the arm-like lock portions 25 outward, the aforementioned lock state of the moving plate 5 by the arm-like lock portions 25 is released.

When the female connector body 38 moves toward the deep position 22 of the hood portion 11, each plate lifting lock 33 of the moving plate 5 passes through the front of each lock deflection regulating portion 23 of the hood portion 11.

When the rotational operation of the lever 39 is terminated, the female connector body 38 moves to the deep position 22 of the hood portion 11 in the state where the plate body 29 of the moving plate 5 is still interposed, as shown in FIG. 12 and FIG. 13. Thus, the male type electric contact portions 8 are perfectly inserted into the female type electric contact portions 42 (see FIG. 3) so as to complete electric connections between the male terminals 6 and the female terminals 40. In this manner, connector fitting between the male connector 2 and the female connector 3 is completed.

In the state of FIG. 12 and FIG. 13, that is, when the moving plate 5 is in the deep position 22 of the hood portion 11, the plate lifting locks 33 of the moving plate 5 are in engagement with the lock portions 50 of the female connector body 38 (see FIG. 14). In addition, the plate lifting locks 33 are regulated from outward deflection by the lock deflection regulating portions 23 as shown in FIG. 15 and FIG. 16.

<Connector Release>

The aforementioned operation of connector fitting is carried out reversely to start to operate and rotate the lever 39 to its initial position. On this occasion, the lock portions 50 of the female connector body 38 are in engagement with the plate lifting locks 33 of the moving plate 5. Therefore, the female connector body 38 lifts up the moving plate 5 and moves to leave the deep position 22 of the hood portion 11. At this time, a force to deflect outward acts on each plate lifting lock 33, but the deflection of the each plate lifting lock 33 is regulated by the lock deflection regulating portion 23. When the female connector body 38 and the moving plate 5 begin to move, the plate lifting lock 33 passes through the front of the lock deflection regulating portion 23 of the hood portion 11.

When the arm action portions 53 of the female connector body 38 abut against the arm-like lock portions 25 of the male connector 2 so as to push the arm-like lock portions 25 outward, the moving plate 5 can be recovered to the aforementioned lock state by the arm-like lock portions 25 (see FIG. 12).

The rotational operation of the lever 39 is terminated, and the lever 39 is returned to its initial position. When the female connector 3 is to be further pulled out from the hood portion 11, the lock portions 50 of the female connector body 38 deflects the plate lifting locks 33 of the moving plate 5 outward as shown by the arrow E in FIG. 18 (the plate lifting locks 33 are not deflected in the falling-over direction in the case of connector release) since the plate lifting lock 33 had passed through the front of the lock deflection regulating portion 23. When each lock portion 50 passes through the protruding tip end side of each plate lifting lock 33, engagement between the lock portion 50 and the plate lifting lock 33 is released (see FIG. 3, FIG. 5 and FIG. 6).

When the female connector 3 is pulled out from the hood portion 11, connector release between the male connector 2 and the female connector 3 is completed.

<When Moving Plate Has Sunk Down to Deep Position of Hood Portion>

When some factor applies an external force to the connector 1 configured thus, the moving plate 5 may sink down to a deep position 24 of the hood portion 11. Assume that a person who does not know the fact that the moving plate 5 has sunk down inserts the female connector 3 into the hood portion 11 in order to perform connector fitting. Even in this case, there is no problem because the connector 1 according to the present disclosure is characterized as follows.

When the moving plate 5 has sunk down to the deep position 24 of the hood portion 11, the plate lifting locks 33 of the moving plate 5 are regulated from deflecting outward by the lock deflection regulating portions 23. However, the plate lifting locks 33 are not regulated from deflecting in the aforementioned falling-over direction. It is therefore possible to perform engagement between the plate lifting locks 33 and the lock portions 50 without any damage.

<Effect of Connector>

As has been described above with reference to FIG. 1 to FIG. 18, when the connector 1 according to the present disclosure is used, there is an effect that at the time of connector release, the moving plate 5 can be lifted up and the moving plate 5 can be returned to its original position. In addition, when the connector 1 according to the present disclosure is used, connector fitting can be performed without any damage even when the moving plate 5 has sunk down.

Although the present disclosure has been illustrated and described for the particular preferred embodiments, it is apparent to a person skilled in the art that various changes and modifications can be made on the basis of the teachings of the present disclosure. It is apparent that such changes and modifications are within the spirit, scope, and intention of the present disclosure as defined by the appended claims.

What is claimed is:

1. A connector comprising:

a male connector comprising a male connector body and a moving plate; and a female connector comprising a female connector body and a lever;

wherein the male connector body comprises a male connector housing made of resin with insulating properties, and a plurality of male terminals are made of metal with electric conductivity;

wherein the moving plate comprises a plate body made of resin with insulating properties;

wherein the female connector body comprises a female connector housing made of resin with insulating properties, and a plurality of female terminals are made of metal with electric conductivity;

wherein the male connector housing comprises a hood portion and a male terminal reception portion, the hood portion receives the female connector movably in a fitting or releasing direction of the male connector and the female connector, and the male terminal reception portion is disposed in a deep position of an internal space of the hood portion;

wherein each of the male terminals comprises a male type electric contact portion and an electric wire connection portion, the male type electric contact portion protrudes from the male terminal reception portion toward the internal space, and the electric wire connection portion is received in the male terminal reception portion continuously to the male type electric contact portion;

wherein the plate body comprises a pair of locked portions and a pair of plate lifting locks, the pair of locked portions are disposed in opposite side portions of the plate body in a longitudinal direction of the male connector perpendicular to the fitting or releasing direction, and the pair of plate lifting locks are disposed in opposite side portions of the plate body in a lateral direction of the male connector perpendicular to the longitudinal direction of the male connector;

wherein the female connector housing comprises a pair of arm action portions and a pair of lock portions, the pair of arm action portions are disposed in opposite side portions of the female connector housing in the longitudinal direction of the male connector, and the pair of lock portions are disposed in opposite side portions of the female connector housing in the lateral direction of the male connector;

wherein the hood portion comprises a pair of arm-like lock portions and a pair of lock deflection regulating portions, the pair of arm-like lock portions are disposed in opposite side portions of the hood portion in the longitudinal direction of the male connector, and the pair of lock deflection regulating portions are disposed in opposite side portions of the hood portion in the lateral direction of the male connector;

wherein a fitting between the male connector and the female connector is performed as:

the moving plate is inserted into the hood portion and the locked portions are locked on the arm-like lock portions so that the moving plate is brought into a temporary lock state and the male type electric contact portions are positioned and protected by the plate body in the temporary lock state;

when the female connector body is inserted into the hood portion in the temporary lock state of the moving plate, the plate lifting locks are configured to be deflected in a falling-over direction which is different from an outside direction of the male connector housing by the lock portions and the plate lifting locks and the lock portions are engaged with each other after the plate lifting locks are deflected in the falling-over direction; and the lever is operated to apply pressure to the plate body by the female connector body while making the female connector body close to the male connector body, and the temporary lock state of the moving plate is released by the arm action portions; and wherein a release between the male connector and the female connector is performed as:

when the lever is operated to keep the female connector body away from the male connector body, deflection of the plate lifting rocks toward in the outside direction is regulated by the lock deflection regulating portions, and the engagement between the plate lifting locks and the lock portions is maintained due to the regulation, while the moving plate is moved to be lifted up together with the female connector body due to the maintained engagement; and when the engagement between the plate lifting locks and the lock portions is released after the moving plate is recovered to the temporary lock state by the arm action portions and after the plate lifting locks are moved to positions where the plate lifting locks are not regulated by the lock deflection regulating portions, the plate lifting locks are deflected in the outside direction by the lock portions so that the engagement between the plate lifting locks and the lock portions is released.

2. The connector according to claim 1, wherein when the temporary lock state of the moving plate is released by external force before the fitting between the male connector and the female connector and the moving plate sinks down into the male terminal reception portion, the plate lifting locks are deflected in the falling-over direction by the lock portions to be engaged with the lock portions.

3. The connector according to claim 1, wherein the outside direction of the male connector housing is same as the lateral direction of the male connector.

4. The connector according to claim 1, wherein the falling-over direction is same as the longitudinal direction of the male connector.

* * * * *